US005613506A

United States Patent [19]

Kurokawa

[11] Patent Number: 5,613,506

[45] Date of Patent: Mar. 25, 1997

[54] DEVICE FOR REMOVING MANICURE

[76] Inventor: Sumie Kurokawa, 3561-4 Oaza Mure, Hofu-Shi, Japan

[21] Appl. No.: 550,638

[22] Filed: Oct. 31, 1995

[30] Foreign Application Priority Data

Nov. 1, 1994 [JP] Japan ..... 6-293758

[51] Int. Cl.[6] ..... A45D 29/00

[52] U.S. Cl. ..... 132/73; 132/73.5; 132/74.5; 132/75; 132/285

[58] Field of Search ..... 132/73, 73.5, 74.5, 132/75, 76.5, 285; 401/127, 128, 183, 130, 198, 202

[56] References Cited

U.S. PATENT DOCUMENTS

| | | | |
|---|---|---|---|
| 4,321,936 | 3/1982 | Chaconas | 132/73.5 |
| 4,474,195 | 10/1984 | Warner | 132/73.5 |
| 4,644,966 | 2/1987 | Ferrari | 132/73 |
| 5,054,503 | 10/1991 | Keller | 132/73 |

*Primary Examiner*—Gene Mancene
*Assistant Examiner*—Pedro Philogene
*Attorney, Agent, or Firm*—Kanesaka & Takeuchi

[57] ABSTRACT

A device for removing a manicure coating from a nail at a fingertip is formed of a container, a soft material impregnated with a manicure removing solution and disposed in the container, a closure removably attached to the upper portion of the container for opening and closing the container, an inner closure rotatably attached to the upper portion of the container and having an opening and a cover for closing the opening, and a sheath attached to the inner closure and extending downwardly therefrom to be situated inside the container. The sheath has a side portion, an inner space at least partly surrounded by the side portion and communicating with the opening, and an open portion formed at the side portion. When the fingertip is inserted into the sheath through the opening, the nail can be located in the open portion. In this position, when the finger is turned together with the inner closure, the manicure coating can be removed from the nail by the manicure removing solution contained in the soft material.

6 Claims, 2 Drawing Sheets

DEVICE FOR REMOVING MANICURE

BACKGROUND OF THE INVENTION

1. Field of the Invention

The present invention relates to a device for removing manicure, which prevents the leakage of a removing solution or a volatile gas of a solvent that generated when a closure is opened, enabling the closure to be opened only when desired so that a finger tip coated with manicure can be inserted therein and is turned to easily remove the manicure coating, without permitting the skin part to be hurt with the removing solution.

2. Description of the Prior Art

A manicure (nail enamel) is a kind of makeup for the fingernails. The manicure itself comprises chiefly a coating-forming agent such as of nitrocellulose, resins that give luster and intimate adhesiveness to the coating, a solvent such as of a plasticizer, alcohol, ester, ketone or the like, and a coloring material which may be a dye or a pigment. In recent years, it has been known that nitrocellulose in the coating-forming agent reacts with keratin which is a protein constituting the nail to thereby change the color of the nail into yellow. Accordingly, a manicure using an emulsified polymer and the water has been developed to substitute for those which use nitrocellulose and organic solvent without, however, finding widespread use yet.

So far, the manicure coating has been removed by using a solvent or an alkali solution as a removing solution; i.e., the manicure coating is simply wiped off by using a sanitary cotton or a sponge (inclusive of cotton-like material, soft plastic foamed material) impregnated with the removing solution. Therefore, the removing solution adheres to the tips of fingers other than the manicure coating, or it often happens that the removing solution is adhered in large amounts to the nails and to the finger tips causing the nails and finger tips to be hurt. Due to such trouble and nuisance, furthermore, many women hesitate to use the manicure though they possess the manicure. This is a problem existing so far.

SUMMARY OF THE INVENTION

In order to solve the above-mentioned Problem, therefore, the present inventor has devised a simply constructed and effective device for removing manicure, and has arrived at the present invention.

It is therefore an object of the present invention to provide a device for removing manicure which prevents leakage of a removing solution or a volatile gas of a solvent that generated when a closure is opened, enabling the closure to be opened only when desired so that a finger tip coated with manicure can be inserted therein and is turned to easily remove the manicure coating, without Permitting the skin part to be hurt with the removing solution.

According to the present invention, there is provided a device for removing manicure wherein a cotton-like material impregnated with a removing solution is contained in a cylindrical container having an air-tight closure, and the tip of a finger is inserted through an opening formed at the central portion of an inner closure which serves as a packing and is opened when the device is in use, and the finger is turned so that the manicure coating is easily removed from the fingernail.

According to another aspect of the present invention, there is further provided a device for removing manicure wherein a fingertip protection sheath having semicircular shape the in cross section is vertically secured in a central portion of the device, an opening is provided in an upper portion of the fingertip protection sheath, and has a soft cover that is opened only when a fingertip is inserted therein but remains closed in other times, and an inner closure is pivotally situated between the cylindrical container and the closure, the inner closure being opened easily when the fingertip is inserted and is turned therein, permitting the manicure-coated nail only to come into contact with the cotton-like material.

DESCRIPTION OF THE PREFERRED EMBODIMENTS

The invention will now be described in detail by way of embodiments.

Figure 1:
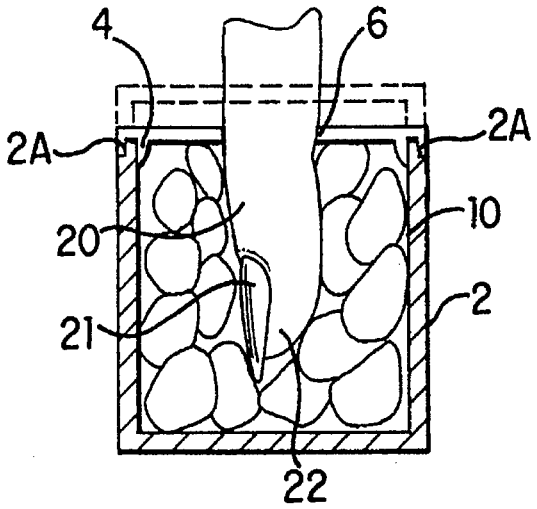
FIG. 1 is a sectional view illustrating the state of using a device according to an embodiment of the invention.
Figure 2:
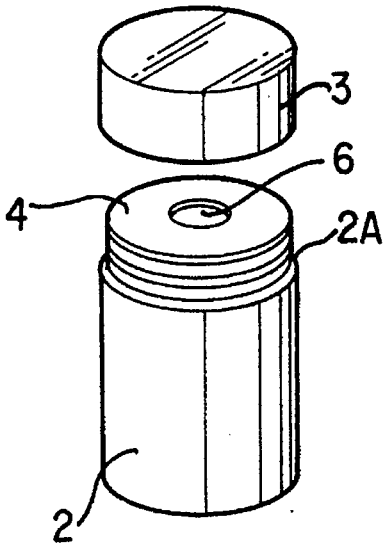
FIG. 2 is a perspective view of the device with a closure being opened according to an embodiment.
Figure 3:
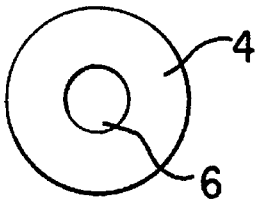
FIG. 3 is a plan view of an inner closure.
Figure 4:
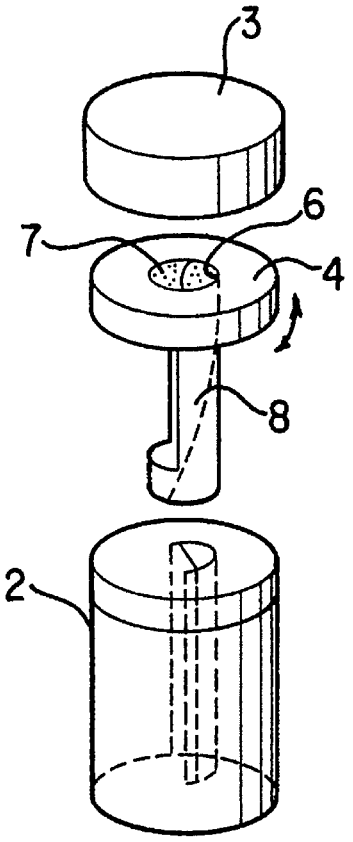
FIG. 4 is an elevated perspective view of a device having the inner closure equipped with a finger tip protection sheath according to another embodiment.
Figure 5:
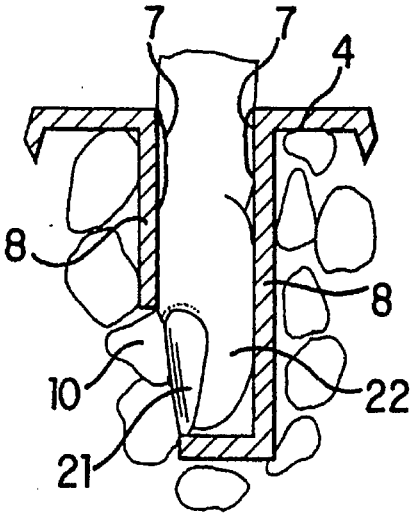
FIG. 5 is a sectional view of the finger tip protection sheath according to still another embodiment.
Figure 6:
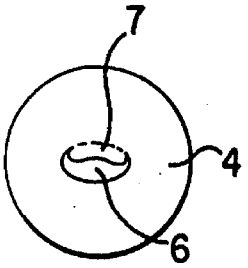
FIG. 6 is a plan view of the inner closure of FIG. 4.

FIG. 2 is a perspective view of the device with a closure being opened, FIG. 1 is a sectional view illustrating the state where the device of FIG. 2 is being used, FIG. 3 is a plan view of an inner closure, FIG. 4 is a perspective view of the inner closure equipped with a fingertip protection sheath according to another embodiment, FIG. 5 is a sectional view of the fingertip protection sheath according to still another embodiment, and FIG. 6 is a plan view of the inner closure of FIG. 4.

In FIGS. 1, 2, 3, 4 and 5, reference numeral 2 denotes a cylindrical container, 2A denotes an externally threaded portion, 3 denotes an air-tight closure, 4 denotes an inner closure, 6 denotes an opening, 7 denotes a soft cover, 8 denotes a finger tip protection sheath, 10 denotes a soft cotton-like material, 20 denotes the tip of a finger, 21 denotes a nail with manicure coating, and reference numeral 22 denotes the skin.

In FIGS. 1 to 6, the cylindrical container and the air-tight closure are made of a glass, a hard plastic material or a metal plate such as of aluminum, or a rubber, a soft plastic material, or a combination of these materials. The externally threaded portion 2A is formed on an upper portion of the cylindrical container and is screwed into an internally threaded portion (not shown) formed on the inside of the air-tight closure 3. A packing may be provided between the air-tight closure 3 and the cylindrical container 2 to maintain air-tightness. However, the number of parts can be decreased if the inner closure 4 is made of a soft plastic material such as polypropylene so as to also serve as a packing.

In FIGS. 1 to 3, the inner closure 4 simply has at its central portion a circular opening 6 which permits the tip 20 of a finger to be inserted therein. In the case of FIGS. 4 and 5, the finger tip protection sheath 8 is extends vertically and is secured in the device, the finger tip protection sheath 8 having the shape of a semi-circle in cross section or having a cylindrical shape as a whole with a portion for the nail only being opened in the semi-circular shape in cross section. The inner closure 4 has a central opening 6 and further has a rubber or plastic soft cover 7 which is formed of two semicircular portions and opened by the force of the finger tip only when the tip of a finger is inserted therein.

It is desired that the finger tip protection sheath 8, soft cover 7, as well as inner closure 4 are made of a soft plastic material such as polypropylene or the like as a unitary structure. Referring to FIG. 6, the opening 6 is formed in the semi-circular shape in order that the inner closure can be turned together with the finger tip when the tip of a finger is inserted and is turned. Due to this turning motion, only the nail coated with manicure is exposed through the finger tip protection sheath 8 and is brought into contact with the cotton-like material 10 impregnated with the manicure-removing solution. The cylindrical container may be formed in the shape of a hollow polygonal cylinder or may contain therein ribs for reinforcement as well as for anchoring in order to prevent the cotton-like material 10 from turning together with the finger tip or the protection sheath.

The above-mentioned object is accomplished by the present invention. That is, there is provided a device for removing manicure which does dot permit the removing solution or a gas thereof to leak when the device is not in use, and can be easily used without hurting non-manicured portions of the tip of a finger.

I claim:

1. A device for removing a manicure coating from a nail at a fingertip comprising:

a container having an upper portion, a soft material impregnated with a manicure removing solution and disposed in the container, a closure removably attached to the upper portion of the container for opening and closing the container, an inner closure rotatably attached to the upper portion of the container, said inner closure having an opening and a soft cover for closing the opening, and a fingertip protection sheath attached to the inner closure and extending downwardly therefrom to be situated inside the container, said sheath having a side portion, an inner space at least partly surrounded by the side portion and communicating with the opening, and an open portion formed at the side portion so that when the fingertip is inserted into the sheath through the opening, the nail can be located in the open portion, the manicure coating being removed from the nail by the manicure removing solution contained in the soft material when the finger is turned together with the inner closure.

2. A device for removing a manicure coating according to claim 1, wherein said soft cover has a slit so that the fingertip passes through the slit when the fingertip is inserted into the sheath.

3. A device for removing a manicure coating according to claim 1, wherein said side portion has a semicircular shape, and said open portion has a semicircular shape and located at a side opposite to the side portion.

4. A device for removing a manicure coating according to claim 1, wherein said side portion has a cylindrical shape, and said open portion has a semicircular shape formed at a bottom portion of the side portion.

5. A device for removing a manicure coating according to claim 4, wherein said open portion has a size to allow the nail directly facing the soft material.

6. A device for removing a manicure coating according to claim 1, wherein the inner closure is formed integrally with the sheath and the cover.

* * * * *